US005339469A

United States Patent [19]

Gilles

[11] Patent Number: 5,339,469

[45] Date of Patent: Aug. 23, 1994

[54] SHOWER APPARATUS

[76] Inventor: Gregory S. Gilles, 2025 N. Lambert, Normal, Ill. 61761

[21] Appl. No.: 130,710

[22] Filed: Oct. 4, 1993

[51] Int. Cl.[5] ..... A47K 3/22

[52] U.S. Cl. ..... 4/601; 4/606; 4/615; 15/205.2; 401/42; 401/43; 239/318; 239/447

[58] Field of Search ..... 4/601, 606, 903; 15/24, 15/29, 205.2; 401/42, 43; 239/310, 317, 318, 447

[56] References Cited

U.S. PATENT DOCUMENTS

| | | | |
|---|---|---|---|
| 987,967 | 3/1911 | Danielson | 15/205.2 X |
| 1,616,514 | 2/1927 | Swimmer | 4/601 X |
| 1,655,375 | 1/1928 | Kundel | 401/43 |
| 1,758,115 | 5/1930 | Kelly | 4/601 X |
| 2,026,981 | 1/1936 | Kahnt | 4/606 X |
| 2,588,255 | 3/1952 | Larsh | 239/318 |
| 2,590,353 | 3/1952 | Schaar et al. | 401/42 X |
| 2,593,178 | 4/1952 | Paul | 401/42 |
| 2,797,132 | 6/1957 | Alpert | 401/43 X |
| 2,867,230 | 1/1959 | Bletcher et al. | 4/601 X |
| 3,471,872 | 10/1969 | Symmons | 4/601 X |
| 4,126,401 | 11/1978 | Stoyshin | 401/42 |
| 4,998,836 | 3/1991 | Scripnick | 401/42 |

*Primary Examiner*—Charles E. Phillips
*Attorney, Agent, or Firm*—E. Michael Combs

[57] ABSTRACT

A shower apparatus includes a primary shower head having fluid connection to a three-way valve member, with the three-way valve member permitting selective fluid flow to the primary shower housing permitting fluid flow selectively to the primary shower head, a pulse shower head, or a brush shower head. The brush shower head is arranged to permit directing a liquid soap through the brush shower head onto a user of the organization.

3 Claims, 4 Drawing Sheets

SHOWER APPARATUS

BACKGROUND OF THE INVENTION

1. Field of the Invention

The field of invention relates to shower apparatus, and more particularly pertains to a new and improved shower apparatus wherein the same is directed to permitting selective utilization of one of a plurality of shower heads.

2. Description of the Prior Art

Shower head apparatus is utilized throughout the prior art such as indicated in U.S. Pat. No. 5,090,624 wherein a hand-held pulsating shower head is provided. A further pulse shower head is indicated in U.S. Pat. No. 5,033,897.

The instant invention attempts to overcome deficiencies of the prior art by providing for individual shower heads selectively employed by individuals operative through a valve member and in this respect, the present invention substantially fulfills this need.

SUMMARY OF THE INVENTION

In view of the foregoing disadvantages inherent in the known types of shower apparatus now present in the prior art, the present invention provides a shower apparatus wherein the same permits the individual use of one of a plurality of shower heads by an individual. As such, the general purpose of the present invention, which will be described subsequently in greater detail, is to provide a new and improved shower apparatus which has all the advantages of the prior art shower apparatus and none of the disadvantages.

To attain this, the present invention provides a shower apparatus including a primary shower head having fluid connection to a three-way valve member, with the three-way valve member permitting selective fluid flow to the primary shower housing permitting fluid flow selectively to the primary shower head, a pulse shower head, or a brush shower head. The brush shower head is arranged to permit directing a liquid soap through the brush shower head onto a user of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shower apparatus which has all the advantages of the prior art shower apparatus and none of the disadvantages.

It is another object of the present invention to provide a new and improved shower apparatus which may be easily and efficiently manufactured and marketed.

It is a further object of the present invention to provide a new and improved shower apparatus which is of a durable and reliable construction.

An even further object of the present invention is to provide a new and improved shower apparatus which is susceptible of a low cost of manufacture with regard to both materials and labor, and which accordingly is then susceptible of low prices of sale to the consuming public, thereby making such shower apparatus economically available to the buying public.

Still yet another object of the present invention is to provide a new and improved shower apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
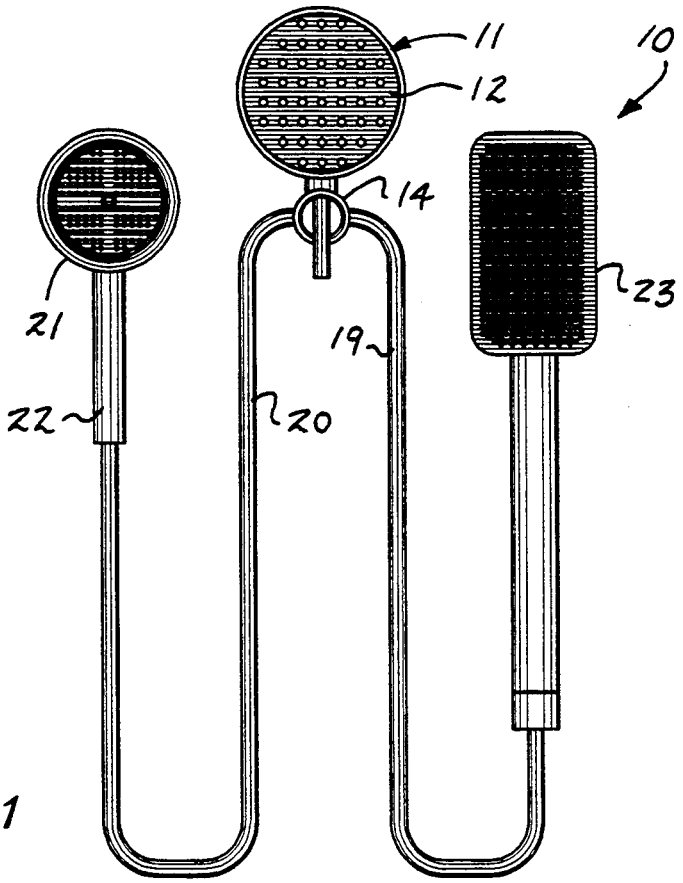
FIG. 1 is an orthographic view of the invention.
Figure 2:
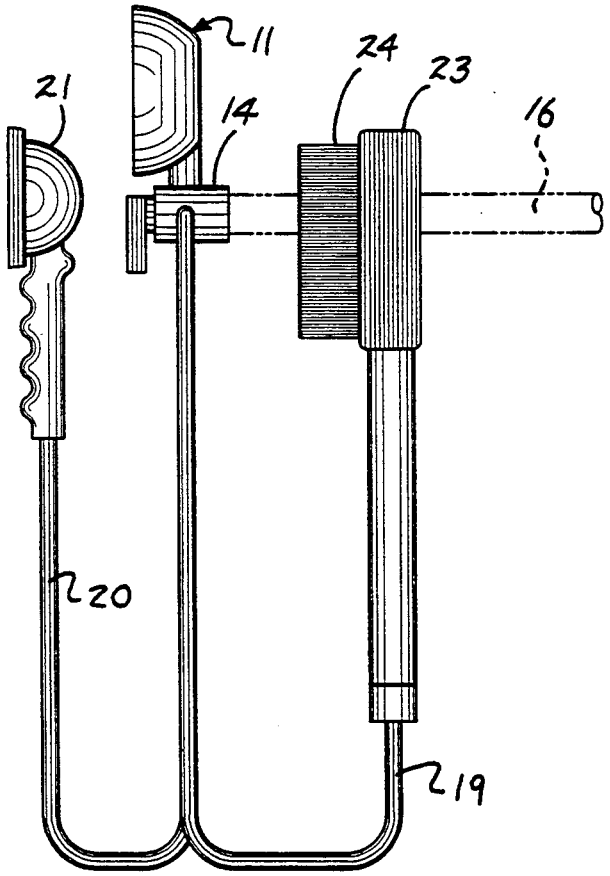
FIG. 2 is an orthographic side view of the invention.
Figure 3:
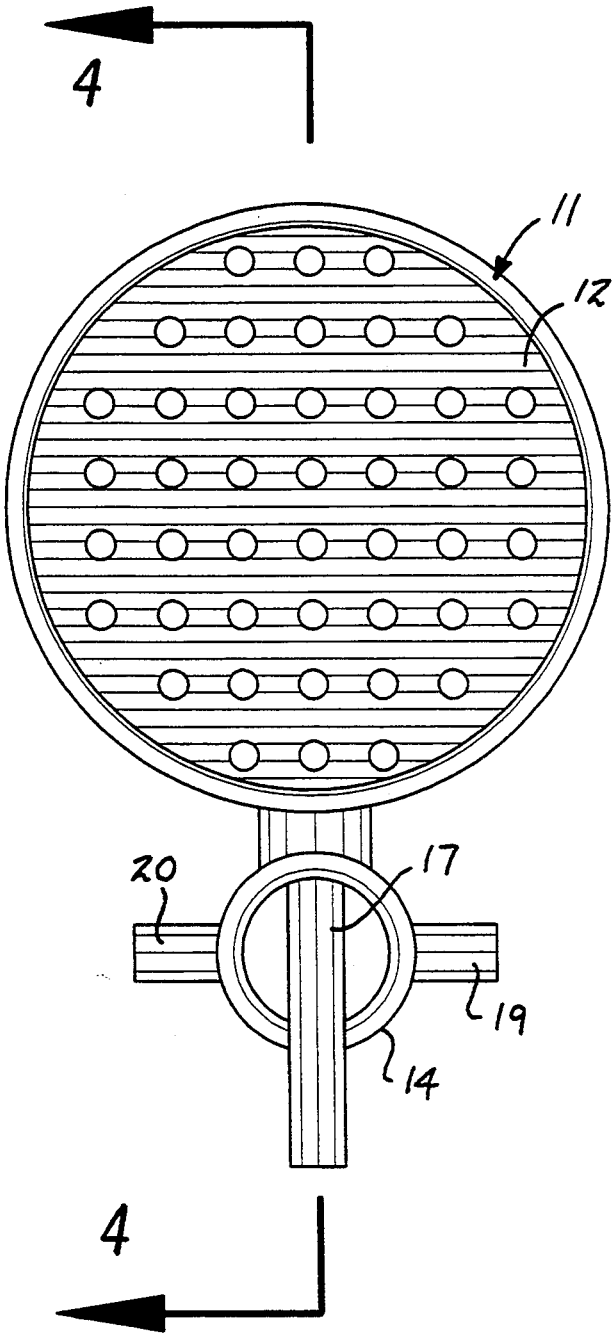
FIG. 3 is an enlarged orthographic view of the primary shower head.
Figure 4:
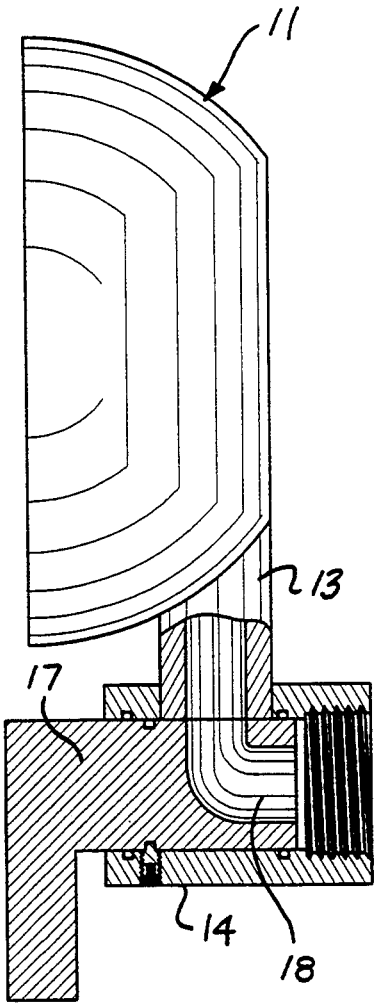
FIG. 4 is an orthographic view, taken along the lines 14—4 of FIG. 3 in the direction indicated by the arrows.
Figure 5:
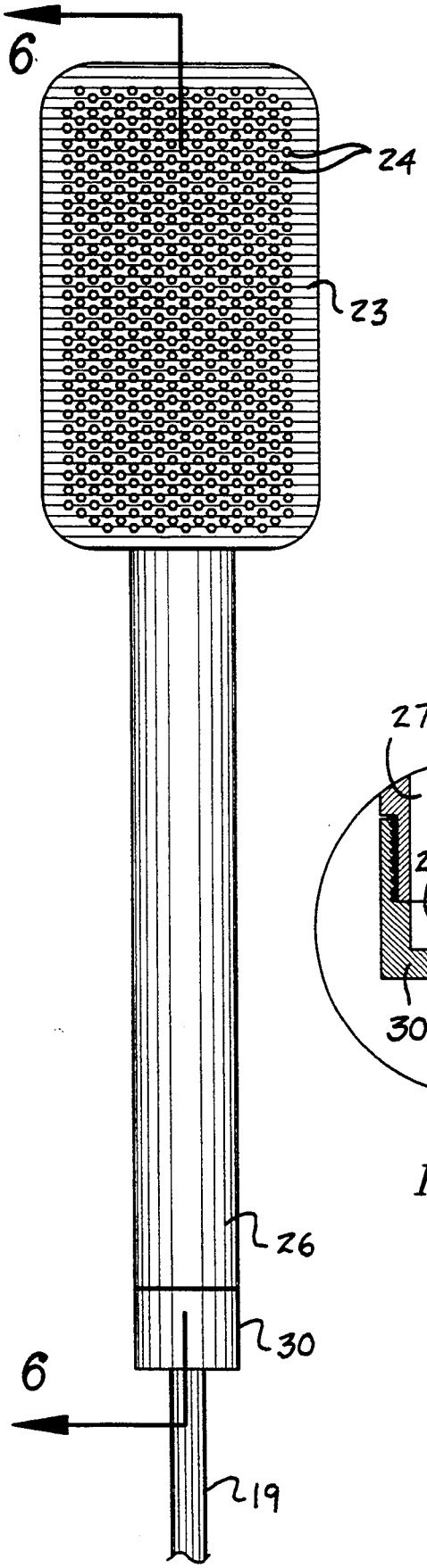
FIG. 5 is an orthographic view of the brush shower head structure.
Figure 7:
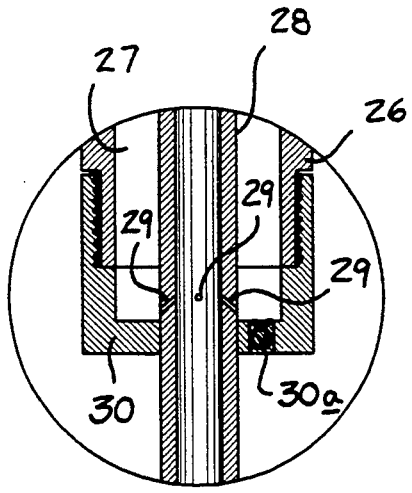
FIG. 7 is an enlarged orthographic view of section 7 as set forth in FIG. 6.
Figure 6:
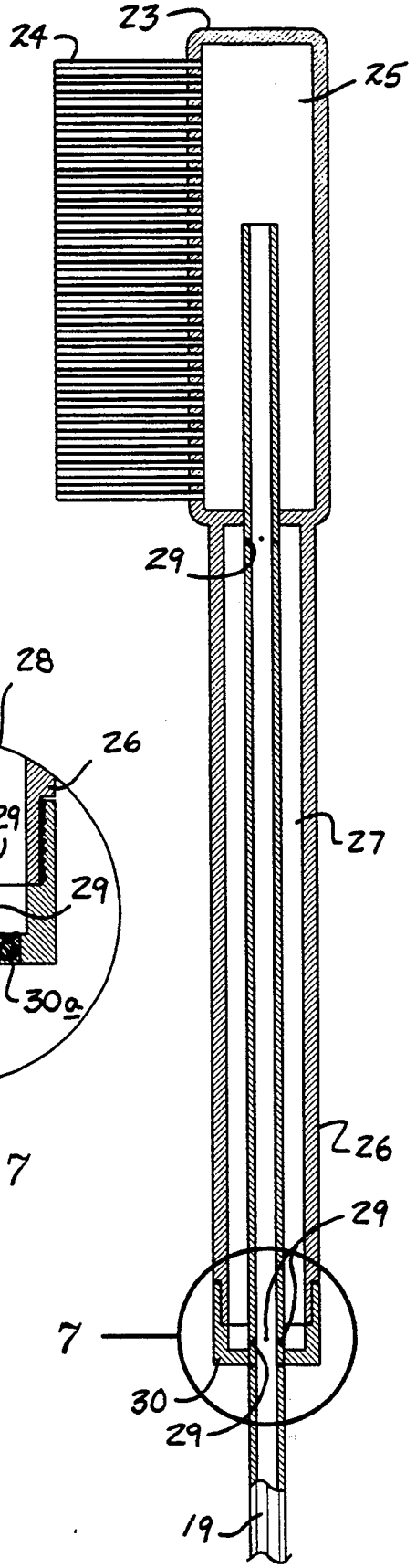
FIG. 6 is an orthographic view, taken along the lines 6—6 of FIG. 5 in the direction indicated by the arrows.

With reference now to the drawings, and in particular to FIGS. 1 to 9 thereof, a new and improved shower apparatus embodying the principles and concepts of the present invention and generally designated by the reference numeral 10 will be described.

More specifically, the shower apparatus 10 of the instant invention essentially comprises a primary shower head 11 having an apertured face plate 12, including a primary shower head conduit 13 in fluid communication with a three-way valve housing 14. Fluid directed through the valve housing selectively into the primary shower head 11 directs fluid flow through the apertured face plate 12. The valve housing is formed with a housing first end to receive a water supply conduit 16, with the second end having a valve shaft 17 directed rotatably therewithin into the housing, with the valve shaft having an L-shaped conduit 18 to permit selective fluid flow between the primary shower head conduit 13 or to a first flexible conduit 19 or to a second flexible conduit 20. The second flexible conduit 20 is directed into a pulse type shower head 21 to a rigid handle conduit 22. The pulse shower head 21 is of any desired construction of a type as exemplified by U.S. Pat. No. 5,090,624 incorporated herein by reference.

The first flexible conduit 19 is directed into a brush shower head 23 through a rigid delivery conduit 28 that is a rigid portion of the first flexible conduit 19 at an interface of a cap member 30 through a brush head rigid tubular reservoir handle 26. The brush shower head 23 includes a plurality of tubular flexible bristles 24 extending therefrom in fluid communication with a brush head fluid cavity 25 receiving fluid through the rigid delivery conduit 23. The rigid tubular reservoir handle 26 defines a reservoir cavity 27 between the tubular reservoir handle 26 and the rigid delivery conduit 28, with the reservoir cavity 27 arranged to receive a fluid or liquid soap therewithin. A plurality of delivery ports 29 extend through the rigid delivery conduit 28 in fluid communication with the reservoir cavity 27 to receive liquid soap through the ports into the rigid delivery conduit 28. The cap member 30 is formed with a threaded securement to the rigid tubular handle 26, with the cap member 30 further formed with a check valve 30*a*.

Figure 8:
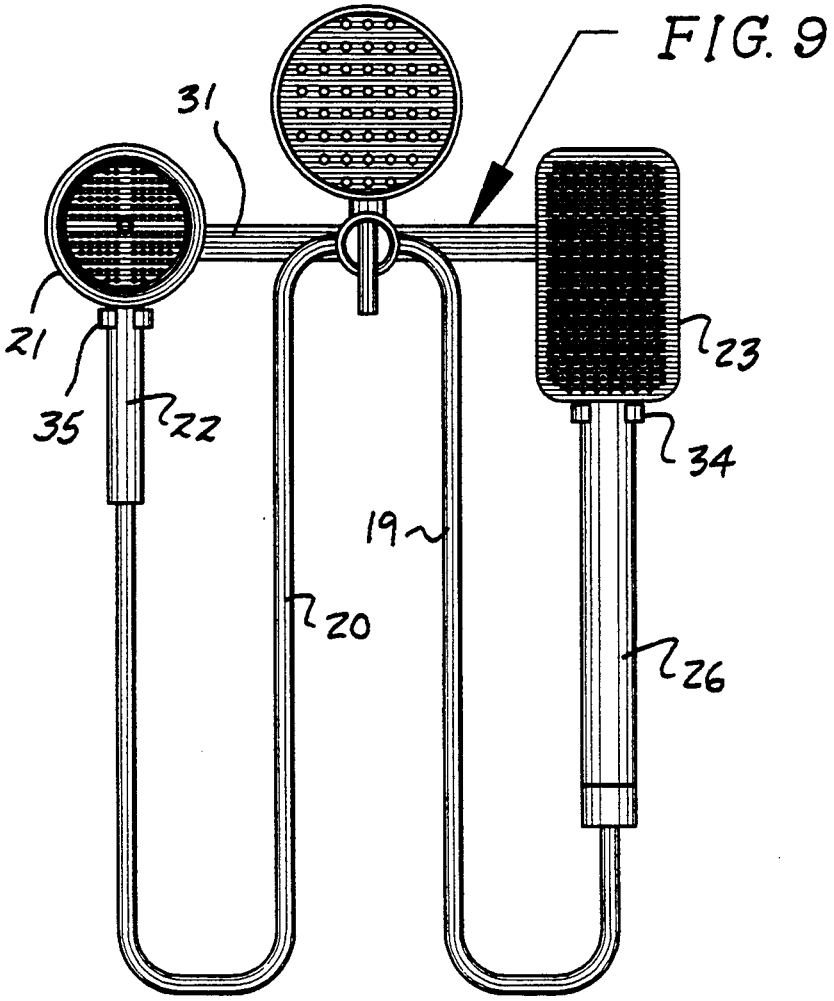
FIG. 8 is an orthographic view of the invention employing a support bar structure.
Figure 9:
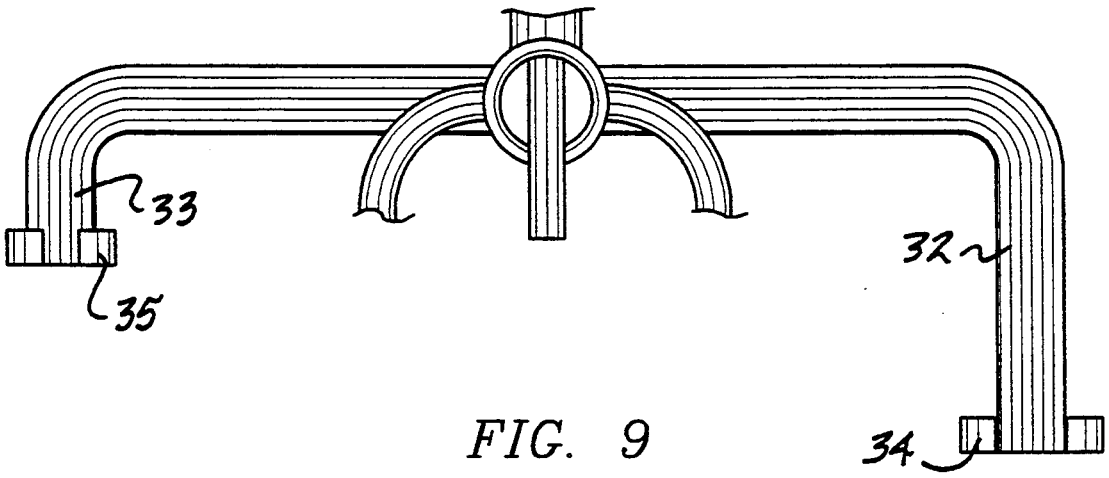
FIG. 9 is an enlarged orthographic view of section 9 as set forth in FIG. 8 to indicate a support bar structure.

The FIGS. 8 and 9 further indicate the use of a support bar 31 formed of a rigid construction, having a support bar first leg 32 spaced from and parallel a support bar second leg 33 that are in turn both fixedly mounted to the support bar 31. A first C-shaped support clip 34 mounted to the first leg is arranged to receive the brush head 23 thereon, while a second C-shaped support clip 35 is arranged to receive the pulse shower head 21 thereon, with the rigid tubular reservoir handle 26 and the pulse shower head rigid handle conduit 22 slidably received through the respective first and second C-shaped support clips 34 and 35 for ease of mounting of the organization to any vertical wall surface (not shown) with any bathing environment.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shower apparatus, comprising, a primary shower head, having an apertured face plate, a primary shower head conduit directed into the primary shower head to conduit fluid flow through the primary shower head conduit and into the primary shower head and through the apertured face plate, with a three-way valve housing mounted fixedly and in fluid communication to the primary shower head conduit, with the three-way valve housing including a first end spaced from a second end, the first end including an inlet for a water supply conduit to be connected thereto, and a valve shaft directed into the second end rotatably within the three-way valve housing, the valve shaft including an L-shaped conduit therewithin, and a first flexible conduit and a second flexible conduit mounted to the three-way valve housing the L-shaped conduit permitting selective fluid flow from the water supply conduit selectively to the first flexible conduit, the second flexible conduit, or to the primary shower head conduit, the second flexible conduit directed into and in fluid communication through a rigid handle conduit, with the rigid handle conduit having a pulse shower head in fluid communication with the rigid handle conduit, the first flexible conduit extending through a rigid tubular handledefining a reservoir therein with the first flexible conduit connected to a rigid delivery conduit coextensive with the reservoir in the rigid tubular handle, with the rigid conduit having a plurality of delivery conduit ports providing fluid communication between the reservoir and the rigid delivery conduit, and a brush shower head mounted on the rigid tubular handle, with the rigid delivery conduit extending into the brush shower head, with the brush shower head including a front wall and a plurality of tubular flexible bristles extending therefrom, and a plurality of openings extending through the front wall;

whereby with the three-way valve positioned to allow passage of supply water through the first flexible conduit, flow will continue into the delivery conduit where the supply water will entrain an additive solution from the reservoir through the ports before departing the delivery conduit into the brush shower head an subsequently through the plurality of openings.

2. A shower apparatus as set forth in claim 1 wherein the rigid tubular reservoir handle includes a cap member threadedly mounted to the rigid tubular handle, and the cap member including a check valve directed through the cap member.

3. A shower apparatus as set forth in claim 2 including a support bar, the support bar including a first leg spaced from and parallel to a second leg, wherein the second leg and the first leg are mounted fixedly to the support bar, and the first leg includes a first C-shaped support clip to receive the rigid tubular reservoir handle slidably therethrough, and a second C-shaped support clip mounted to the second leg to receive the rigid handle conduit slidably therethrough.

* * * * *